US011946243B2

(12) United States Patent
Schmid et al.

(10) Patent No.: US 11,946,243 B2
(45) Date of Patent: Apr. 2, 2024

(54) WORK AND RECREATION SPACE MODULE FOR A WORK ENVIRONMENT

(71) Applicant: FRAUNHOFER-GESELLSCHAFT ZUR FÖRDERUNG DER ANGEWANDTEN FORSCHUNG E. V., Munich (DE)

(72) Inventors: Andreas Schmid, Ofterdingen (DE); Bastian Pokorni, Braunschweig (DE)

(73) Assignee: Fraunhofer-Gesellschaft zur Förderung der angewandten Forschung e.V., Munich (DE)

( * ) Notice: Subject to any disclaimer, the term of this patent is extended or adjusted under 35 U.S.C. 154(b) by 35 days.

(21) Appl. No.: 17/475,869

(22) Filed: Sep. 15, 2021

(65) Prior Publication Data

US 2022/0081894 A1 Mar. 17, 2022

(30) Foreign Application Priority Data

Sep. 16, 2020 (DE) ..... 10 2020 211 615.6

(51) Int. Cl.
*E04B 1/344* (2006.01)

(52) U.S. Cl.
CPC ..... *E04B 1/3442* (2013.01)

(58) Field of Classification Search
CPC .. E04B 1/34336; E04B 1/3431; E04B 1/3442; E04B 1/3444; E04B 1/34357;
(Continued)

(56) References Cited

U.S. PATENT DOCUMENTS 2,319,581 A * 5/1943 Brownlee ..... B60B 33/06 280/43.14
4,987,706 A * 1/1991 Hughes ..... E04B 1/8218 52/79.5

(Continued)

FOREIGN PATENT DOCUMENTS

DE 112016007426 T5 8/2019
GB 329088 A 5/1930

OTHER PUBLICATIONS

German Patent Office, Office Action in German Patent Application No. 10 2020 211 615.6 (dated May 18, 2021).

*Primary Examiner* — Basil S Katcheves
*Assistant Examiner* — Daniel J Kenny
(74) *Attorney, Agent, or Firm* — Leydig, Voit & Mayer, Ltd.

(57) ABSTRACT

Disclosed is a work and recreation space module for a work environment, particularly for a production and/or presentation and/or outer environment, having an inner element which has at least one seat for a user, having a rolling device for rolling the inner element into different positions in the work environment; and an outer element which has two side walls and a roof wall connecting the side walls, wherein the inner element can be received in an inner space of the outer element delimited by side walls and roof wall; and a mechanical coupling device with which the inner element and the outer element can be coupled to one another, so that the outer element can also be rolled with the inner element into different positions in the work environment, in order to provide a work and/or recreation area that can be used flexibly in a work environment.

12 Claims, 3 Drawing Sheets

Figure 1C:
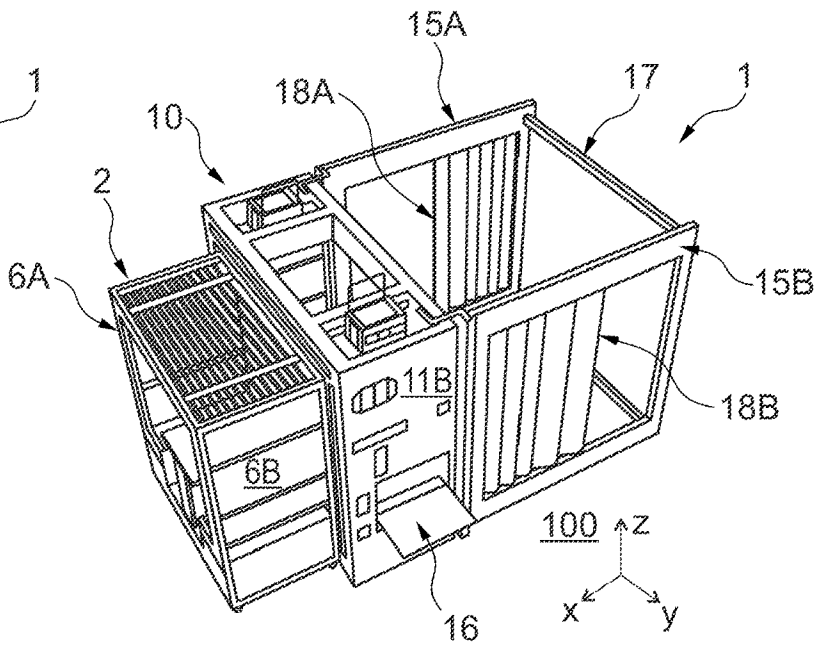

(58) Field of Classification Search
CPC ..... E04B 1/344; E04B 1/34384; E04H 1/12; E04H 6/04; E04H 2001/1283; E04H 1/1205
See application file for complete search history.

(56) References Cited

U.S. PATENT DOCUMENTS

| | | | | |
|---|---|---|---|---|
| 5,282,341 | A * | 2/1994 | Baloga | E04H 1/1272 52/239 |
| 6,402,271 | B1 * | 6/2002 | Kelley | A47B 83/045 312/196 |
| 8,141,927 | B2 * | 3/2012 | Kreil | B60P 3/34 296/165 |
| 8,720,126 | B2 * | 5/2014 | Strickland | E04H 1/1205 52/79.5 |
| 8,978,679 | B2 | 3/2015 | Jennings | |
| 9,127,872 | B1 * | 9/2015 | Chainey | F25D 11/003 |
| 9,458,623 | B2 * | 10/2016 | Duncan | A01G 9/14 |
| 10,278,523 | B2 * | 5/2019 | Ringel | A47B 96/066 |
| 10,457,188 | B1 * | 10/2019 | Mackay | B62D 65/02 |
| 10,794,076 | B2 | 10/2020 | May | |
| 10,975,564 | B2 * | 4/2021 | Watanabe | E04B 1/34846 |
| 11,136,771 | B2 * | 10/2021 | Petty | E04B 1/34357 |
| 11,377,844 | B2 * | 7/2022 | Clifton | E04B 1/34363 |
| 2002/0024274 | A1 * | 2/2002 | Swaab | E04B 2/7416 312/201 |
| 2002/0153227 | A1 * | 10/2002 | Broich | B23P 19/062 198/380 |
| 2018/0043761 | A1 | 2/2018 | May | |
| 2020/0032504 | A1 | 1/2020 | Song | |
| 2020/0347626 | A1 * | 11/2020 | Petty | E04H 1/1255 |
| 2021/0363747 | A1 * | 11/2021 | Leclerc | A47B 77/08 |
| 2022/0275631 | A1 * | 9/2022 | Zail | E04B 1/3431 |

* cited by examiner

WORK AND RECREATION SPACE MODULE FOR A WORK ENVIRONMENT

CROSS-REFERENCE TO A RELATED APPLICATION

This patent application claims the benefit of German Patent Application No. 10 2020 211 615.6, filed on Sep. 16, 2020, the disclosure of which is incorporated herein by reference in its entirety for all purposes.

BACKGROUND OF THE INVENTION

Production environments are changing rapidly today In the course of digitization, particularly: complex workflows and constant changes in processes and products require more creativity and flexible cooperation between employees, even in a production environment. However, there are generally no suitable space solutions available within production environments. Accordingly, space productivity and multiple use of space within work environments such as factories are becoming more and more important today. The unanswered question, however, is how something like this can actually be implemented in existing infrastructures. Especially flexible solutions that still comply with relevant safety regulations such as fire protection and protection against contamination are desirable here.

The invention is therefore based on the object of providing a work and/or recreation area that can be used flexibly in a work environment.

This object is achieved by the features of the independent patent claim. Advantageous embodiments emerge from the dependent claims, the description and the figures. The invention relates to a work and recreation space module for a work environment, particularly for a production and/or presentation and/or an external environment, such as a factory or a trade fair, having an inner element that has at least one seat for a human, having a rolling device for active or passive rolling of the inner element in different positions in the work environment.

One aspect of the invention relates to a work and recreation space module for a work environment, particularly for a production environment such as a factory environment or other industrial environment, a retail environment, a supply environment, or an administrative environment, and/or for a presentation environment such as a trade fair environment, a conference environment, or the environment of some other public event. The work and recreation space module can also be used in other public areas, such as a school area, a kindergarten area, a hospital area and an airport area. The work and recreation space module can also be designed for an external environment, for example, free-standing on a lawn or some other ground. The work and recreation space module described can also be referred to as a module for a flexible work and/or recreation area for one or more users.

The work and recreation space module has an inner element which has at least one seat for one or more users, preferably two or four seats with one or two seats each, which are arranged on opposite sides of an associated table. The inner element also has a rolling device for rolling the inner element into different positions in the work environment. The rolling can be an active and/or a passive rolling, that is, the inner element can be pushed into the different positions thanks to the rolling device, that is, rolled passively, and/or moved into the different positions via a rolling device equipped with a drive, that is, actively rolled. For this purpose, the rolling device can have more than two rollers, in particular exactly four rollers. Preferably, the work and recreation space module has exactly one inner element. The inner element thereby preferably has a height of at most 270 cm in a height direction, particularly preferably at most 250 cm, and/or a depth of at most 200 cm in a depth direction, particularly preferably at most 150 cm. Height and depth can be measured at corresponding side walls of the inner element in their main extension planes, which accordingly have at most the mentioned height and/or depth. The work and recreation space module also has an outer element which has two side walls and a roof wall connecting the side walls. The outer element thus particularly has the shape of an inverted U, wherein the roof wall forms the bottom or the roof of the inverted U and the two side walls form the side legs of the U. The side walls and the roof wall delimit an inner region of the outer element in which the inner element can be received at least partially, that is, partially or completely. Correspondingly, the outer dimensions of the inner element are adapted to the clear dimensions of the inner region of the outer element such that the inner element can be pushed or rolled into the inner region of the outer element. Advantageously, a width and/or height of the inner region of the outer element corresponds to a width and/or height of the inner element except for a predetermined clearance, which is necessary so that the inner element, under the conditions of daily use, that is, with intended use with maximum space utilization of the inner region, can easily be pushed into the inner region through the inner element. The work and recreation space module also has a mechanical coupling device with which the inner element and the outer element can be mechanically coupled to one another so that the outer element can also be rolled into different positions in the work environment with the inner element by the rolling device of the inner element. Alternatively or additionally, the outer element can also have a rolling device for (actively and/or passively) rolling the outer element into different positions in the working environment. The rolling device can have more than two rollers for this purpose, in particular exactly four rollers. In the case of a work and recreation space module configured or intended for an external environment, this can have, preferably on the roof wall of the outer element, a power supply device, particularly a solar power supply device, for partially or fully self-sufficient power supply of the work and recreation space module. Preferably, the work and recreation room module has exactly one outer element.

Preferably, the outer element has a height of at most 270 cm, especially preferably at most 250 cm, in a height direction and/or a depth of at most 200 cm, especially preferably at most 150 cm, in a depth direction and/or a width of at most 300 cm, especially preferably at most 260 cm, in a width direction. Height and depth can thereby be measured at the side walls of the outer element in their main extension planes, which accordingly have at most the mentioned height and/or depth. Depth and width can be measured at the roof wall of the outer element in its main extension plane, which accordingly has at most the said depth and/or width.

This results in a number of advantages, which enable a particularly flexible design of the work environment using the work and recreation space module. Because the inner element can be moved into the outer element and this can be moved around in the work environment, so to speak, as a backpack, the minimum space required for the work and recreation space module in the work environment is simultaneously minimized (nested configuration) and the space that can be taken up thereby and thus designed in the work environment is maximized (extended configuration), wherein the manageability of the work and recreation space module is maximized when moving from one position to the other by coupling the inner and outer elements, since the module forms a compact unit that can be moved. This provides a spatially changeable and, at the same time, resizable solution for the multiple use of areas within a work environment and thus for an increase in the productivity of the area. Using the work and recreation space module, short-term recreation areas can be set up close to the corresponding workstations for shorter breaks, and creative, presentation or retreat spaces can be set up or configured in a flexible manner. Situational isolation can also be implemented flexibly and at short notice as protection against infection.

The rolling device and the mechanical coupling device are advantageously designed such that they can be operated without tools, and thus the work and recreation space module can be pushed into one another, coupled, moved, decoupled and pushed apart again within a short time by the user or users. Thus, with little technical effort for a flexible number of users in the respective work environment, zones can be divided for different uses by the respective users, for example, use of a break and use of a presentation. A change of the respective work or break situations is possible using the described work and recreation space module without great effort, since no usage configuration is rigidly predefined, or different parts of the work and recreation space module can be configured and used simultaneously or one after the other for different applications. The described work and recreation space module also enables a simple solution for the situational, needs-based temporary isolation of parts of the work environment from the rest of the work environment, as is advantageous, for example, for infection control, emission control or data protection.

In an advantageous embodiment, it is provided that the inner element has a hydraulic and/or electrical lifting device for lifting the inner element and thus also the outer element, in the event that the inner element is pushed or received into the inner region of the outer element. The lifting device can particularly be part of the coupling device or interact therewith. This is particularly advantageous in the preferred case in which the outer element does not have its own rolling device for rolling into different positions in the work environment, since the inner element and outer element can be configured as a common movable unit movable by a (particularly manual) shifting by one or more operators with little effort and quickly by lifting the inner element located in the inner region of the outer element by the lifting device. The mechanical coupling can be implemented by the coupling device with a simple nose in one element which, when raised, engages in a recess of the other element, preventing the outer element from slipping relative to the inner element.

Another advantageous embodiment provides that the inner element has two side walls and a roof wall connecting the side walls and/or a bottom connecting the side walls. The walls and/or the bottom delimit an inner region of the inner element. The at least one seat can be arranged in the inner region. If the inner element is coupled to the outer element by means of the mechanical coupling device, the side walls of the inner element preferably run along the side walls of the outer element, that is, parallel or at least substantially parallel to the side walls of the outer element. The roof wall of the inner element then accordingly runs along, that is, at least substantially parallel to, the roof wall of the outer element. Here and in the following, "substantially" can be understood to mean "except for a predefined deviation", wherein the predefined deviation can be, for example, less than 1°, less than 2° or less than 5°. The main extension plane of the side walls is specified by a depth direction and a vertical direction of the corresponding element, the main extension plane of the roof wall by the depth direction and a width direction of the respective element.

This has the advantage that a corresponding spatial region can be flexibly separated from the rest of the work environment in a particularly effective manner, for example, by placing the outer and inner element face to face together and thus, even without the further devices or elements explained below, a spatial region of several square meters can be separated from the work environment, which spatial region is only open on opposite end faces. The end faces are the sides associated with the edges of the side and roof walls. If, for example, the inner element or the outer element is arranged with one end face on a wall, then only one end face, via which the created separated space can be entered, is open with respect to the rest of the work environment. In this way, a relatively large spatial region, which is particularly well shielded from the rest of the work environment, can be created with very little effort.

Accordingly, in a further advantageous embodiment, it is provided that the inner space of the inner element or outer element is open to an environment of the respective element on at least one of two, particularly two, end faces of the respective inner element or outer element that run transversely to the side walls and roof wall. The respective inner or outer element can thus be traversed in the depth direction. With one or more possibly existing additional (privacy and/or sound protection) devices of the respective elements and/or with one or more possibly existing additional (inner and/or outer and/or hinged wall) elements, as they are described further below, this applies at least in one configuration of the corresponding devices or elements. As has been shown, this configuration is particularly advantageous in order to flexibly support a plurality of work and break situations using the work and recreation space module.

In another advantageous embodiment, it is provided that a privacy protection device and/or sound protection device is arranged on one or both side walls of the inner element and/or the roof wall of the inner element and/or at least one respective hinged wall element, as will be introduced below, for optical and/or acoustic separation of the inner space element from an environment of the inner element. For example, the privacy and/or sound protection device can be a curtain device which realizes a predetermined acoustic attenuation of, for example, 3 dBA. This has the advantage that the corresponding division or separation of the respective spaces is particularly flexible, wherein the inner space of the inner element can be acoustically and/or optically separated from the inner space of the outer element or an inner space of a further inner element using the privacy or sound protection device, which makes the possible uses of the work and recreation space module even more flexible and increases said possible uses, especially if a plurality of work and recreation space modules is used together or a work and recreation space module having more than one of the described inner or outer elements is used.

In a further advantageous embodiment it is provided that at least one respective inner side and/or outer side of the side walls of the outer element and/or at least one respective outer side of the inner element and/or at least one respective hinged wall element, as will be introduced below, can be provided or are provided with one or a plurality of productive devices, preferably are provided for this purpose with a uniform productive device fastening interface. The productive device can particularly be or comprises a whiteboard productive device and/or a pin board productive device and/or a flipchart productive device and/or a monitor productive device and/or a folding table productive device and/or an acoustic wall productive device, which is acoustically effective, for example, through perforated surfaces. The named productive devices can thus be modular productive devices, by means of which the respective element or elements can be reconfigured via the uniform productive device fastening interface, preferably without tools. This has the advantage that the work and recreation space module not only provides an inner space that can be used for a specific activity within a work environment, as is customary in the prior art, but an additional functionality is also created simultaneously on the respective outer sides, that is, in the remaining work area, which is not the inner space of the respective elements or belongs thereto or in the respective other inner space. Thus, for example, a presentation can be carried out at the same time on an outer side of the outer element and a confidential meeting in the inner space of the outer element at the same time or at a different point in time.

In a further advantageous embodiment, it is provided that a respective hinged wall element is arranged pivotably about a vertical axis of the outer element that runs parallel to the side walls and the end faces on one, particularly only one, of two end faces of the outer element running transversely to the side walls and roof wall, at least on one side wall of the outer element, preferably on both side walls of the outer element. Particularly, the folding element(s) is/are arranged so as to be lockable at different, preferably arbitrary, pivoting angles. A pivoting angle range of, for example, up to 180°, up to 210°, or up to 270° can be specified for the pivoting angle. A rolling device can be provided at an (outer) end region of the respective hinged wall element remote from the outer element, so that the one or more hinged wall elements can be pivoted with respect to the outer element with less effort. This has the advantage that a space in the work environment can be separated even more flexibly, but which at the same time has practically no increased space requirement when not in use.

The hinged wall elements can comprise a holding device for a whiteboard device and/or a screen device and/or the like, so that the hinged wall element not only provides a separating function, but also a further functionality. The holding device can also comprise or be the uniform productive device fastening interface. The holding device can also comprise a frame on which a whiteboard device and/or a screen device and/or the like, for example, the further productive devices mentioned, can be attached, for example, suspended.

The at least one hinged wall element preferably has an adjustable privacy and/or sound protection device, for example, a curtain, which particularly can be closed or opened electrically or manually between two transparent panes. The arrangement of the curtain between two transparent panes reduces the risk of damage, which is often present in a productive environment, and also prevents the curtain from becoming soiled. In addition, the region to be separated from the rest of the work environment can also in turn be separated from the work environment in a functionally diverse manner. Also, the region to be separated from the rest of the work environment can in turn be separated from the work environment in a functionally diverse manner. If there are no panes, the hinged wall element can preferably be climbed through with the curtain open, thus providing a passage opening (which can be at least partially, that is, partially or completely closed by the privacy and/or sound protection device).

In an advantageous embodiment, it is provided that the dimensions of the at least one hinged wall element are adapted to the size of the end face of the outer module, so that the inner region of the outer element on the associated end face can be delimited from an environment of the outer module by the at least one hinged wall element. In this case, a width of the hinged wall element in the state in which it is folded onto the outer module advantageously corresponds to a width of the outer module. In an alternative embodiment having two hinged wall elements, the width of a hinged wall element corresponds to a proportion of x of the width of the outer module, and a width of the other hinged wall element corresponds to a width of (1-x) of the width of the outer module. In this way, in addition to separating spaces from the work environment, door functionality can also be implemented for the inner space of the outer element.

In a further advantageous embodiment, it is provided that the inner element and the outer element have an electrical coupling device, particularly a power supply coupling device and/or a data supply coupling device, via which, at least when the inner element is coupled to the outer element by means of the mechanical coupling device, the inner element and the outer element are electrically coupled or can be coupled to one another. The electrical coupling device can be made contact-bound (wired) or contact-free (wireless). The inner and outer elements can be electrically coupled to one another via the electrical coupling device, when the inner and outer elements are coupled to one another and, for example, also when the inner element is pushed into or onto the outer element. In this case, only the inner element or only the outer element preferably has a power supply interface for supplying the inner element and/or outer element with power, so particularly only a single common power supply interface may be provided for supplying the electrically coupled outer and inner elements with power from one external power supply source. This has the advantage that no flying cabling or only a minimum amount of flying cabling is required for the respective functionalities and devices of the outer or inner element.

Accordingly, in a further advantageous embodiment, it can be provided that the inner element and/or the outer element and/or the at least one hinged wall element has a current draw point, commonly known as a socket, and/or a lighting device and/or a data extraction point. Particularly, the inner element and/or the outer element can contain a store for electrical energy. This has the advantage that the work and recreation space module can be used particularly flexibly, since the demands on the work environment are reduced.

In a further advantageous embodiment, it can be provided that the inner element and/or the outer element and/or the hinged wall element(s) have at least one respective coupling device for mechanically and/or electrically coupling another element of the same or a different element type. Correspondingly, via the respective coupling device, for example, the inner element of a work and recreation space module can be coupled to an inner element of another work and recreation space module, or also, for example, a hinged wall element or an outer element of the other work and recreation space module. The respective coupling devices are preferably standardized (universal) and thus independent of the type of the respective other element or elements. This further increases the possibilities of use in the flexible arrangement and division of the work environment made possible by the work and recreation space module.

Accordingly, a further aspect of the invention relates to a work and recreation space module system having at least one work and recreation space module according to one of the described embodiments, particularly having at least one further inner element and/or a further outer element, as is carried out in the context of the work and recreation space module described.

The features and combinations of features mentioned above in the description, also in the introductory part, and the features and combinations of features mentioned below in the description of the figures and/or shown alone in the figures, can be used not only in the respectively specified combination, but also in other combinations, without departing from the scope of the invention. There are thus also embodiments of the invention to be regarded as encompassed and disclosed, which are not explicitly shown and explained in the figures, but emerge and can be generated from the explained embodiments by means of separate combinations of features. Designs and combinations of features are also to be regarded as disclosed, which therefore do not have all the features of an originally formulated independent claim. In addition, designs and combinations of features, particularly through the statements set out above, are to be regarded as disclosed which go beyond the combinations of features set forth in the back-references of the claims or differ therefrom.

BRIEF DESCRIPTION OF THE SEVERAL VIEWS OF THE DRAWING(S)

Figure 1B:
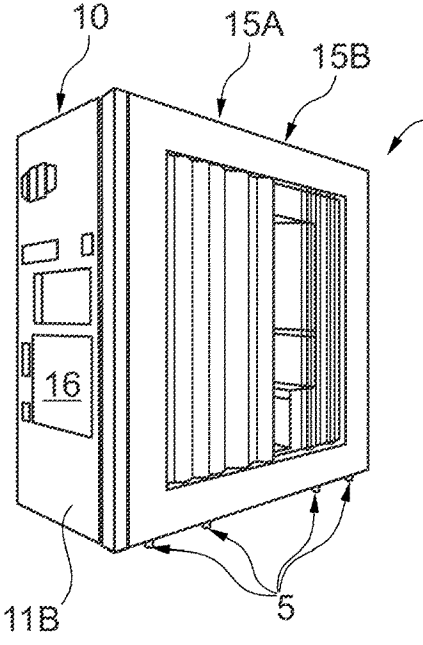
Figure 1A:
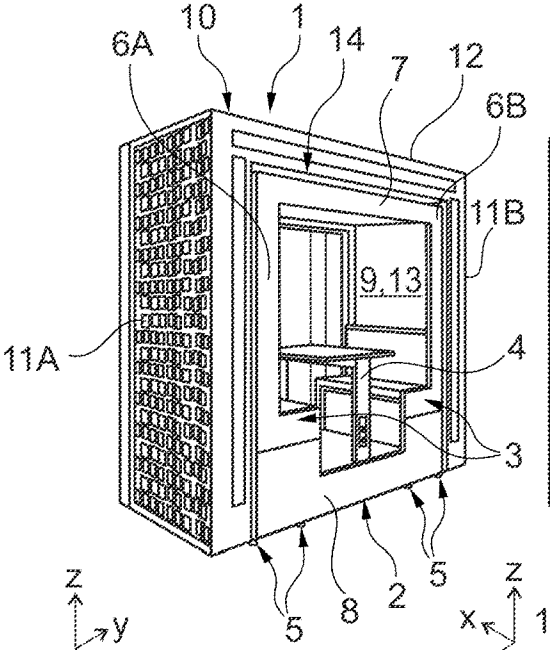

The subject according to the invention is to be explained in more detail with the aid of the schematic drawings shown in the following figures, without wishing to restrict it to the specific embodiments shown here. Shown are:

FIGS. 1A-1C a perspective view of an embodiment of a work and recreation space module in two different configurations;

FIGS. 2A-2D a schematic representation of different configurations of the embodiment of FIG. 1 in a top view; and FIG. 3A-3D a schematic representation of exemplary usage variants of the exemplary work and recreation space module of FIG. 1.

Identical and functionally identical components are provided with the same reference symbols.

DETAILED DESCRIPTION OF THE INVENTION

FIG. 1A shows an embodiment of a work and recreation space module 1 in a perspective view from a first, front end face. The work and recreation space module 1 has an inner element 2 having at least one seat 3, here four seats 3, which in the present example are arranged on opposite sides of a table 4. The inner element 2 has a rolling device 5 for rolling the inner element 2 into different positions in a work environment. Furthermore, in the embodiment shown, the inner element 2 has two side walls 6A and 6B, and a roof wall 7 connecting the side walls 6A, 6B and a bottom 8 connecting the side walls 6A, 6B. The walls 6A, 6B, 7 and the bottom 8 delimit an inner space 9 of the inner element 2.

The work and recreation space module 1 also has an outer element 10, which has two side walls 11A and 11B, and a roof wall 12 connecting the side walls 11A and 11B. The walls 11A, 11B, 12 delimit an inner space 13 of the outer element 10. In the present case, the inner element 2 can be completely received in the inner space 13 of the outer element.

A mechanical coupling device 14 is arranged between the inner element 2 and the outer element 10, for example, between the respective roof walls 7 and 12, with which mechanical coupling device 14 the inner element 2 and the outer element 10 can be coupled to one another. With the inner element 2, the outer element 10 can thus also be rolled into different positions in the work environment by the rolling device 5.

In FIG. 1B, the work and recreation space module 1 from FIG. 1A is shown from a second, rear end face. The end face shown is separated from an environment of the outer element 10 by two hinged wall elements 15A, 15B. In the example shown, the side wall 11B is equipped with a productive device 16, as is also possible for the side wall 11A or the side walls 6A or 6B of the inner element, which productive device 16, as shown in FIG. 1C, comprises a fold-out monitor production device.

The hydraulic and/or electrical lifting device of the inner element (2) is depicted as (19) in FIG. 1A and FIG. 1B.

In FIG. 1C, the work and recreation space module 1 is shown with an inner element 2 pulled out of the inner space 13 of the outer element 10. The inner element 2 is arranged with its end face on a corresponding end face of the outer element 10. Furthermore, the hinged wall elements 15A, 15B are unfolded, that is, in the example shown at an angle of 90° to the associated end face, so that they run parallel to the side wall 11A or 11B of the outer element 10. This separates a particularly large part of the work environment from the rest of the work environment. In the example shown, this is supported by a further wall 17, which can be, for example, the wall of an infrastructure of the production or presentation environment, or also a flexible, for example, suspendable, further wall 17. Alternatively or additionally, a roller blind element can be provided here and in other embodiments, which roller blind element is attached to the outer element 10, preferably to the roof wall 12. The roller blind element is designed to form a cover for the space between the two hinged wall elements 15A, 15B along which the hinged wall elements 15A, 15B, which are set out at a 90° angle, are extended. Particularly, the roller blind element is also designed to be pulled vertically downwards at the end of the two hinged wall elements 15A, 15B remote from the outer element 10 instead of the further wall 17 that can be suspended, in order to take the place of the further wall 17 that can be suspended.

In the present example, the dimensions of the hinged wall elements 15A, 15B correspond to the dimensions of the outer element 10, so that in each case one hinged wall element 15A, 15B can already cover the entire end face of the outer element 10 in order to separate the inner space 13 of the outer element 10 from the respective environment. The hinged wall elements 15A, 15B in the present case also have corresponding privacy and/or sound protection devices 18A, 18B, which are half-closed in the example shown. For example, fastening devices for further productive devices, for example, for corresponding whiteboard devices or screen devices, are located on the outer sides, that is, the sides of the hinged wall elements 15A, 15B facing the environment 100 of the work and recreation space module 1. Correspondingly, as shown here by way of example for the one outer side of the side wall 11B of the outer element 10, a productive device 16, in this case a computer workstation as a monitor productive device 16, is arranged on said side wall 11B. This is fastened to the side wall 11B using a uniform productive device fastening interface (not shown), so that the productive device 16 shown can be replaced by other productive devices with little effort in a modular manner.

In FIGS. 2A-2D, respective schematic representations of configurations of the work and recreation space module 1 are shown schematically in a top view.

Figure 2A:
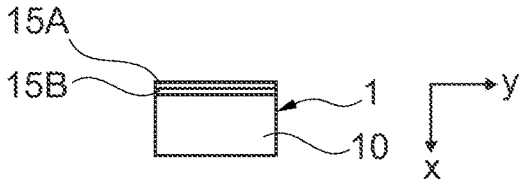
Figure 2B:
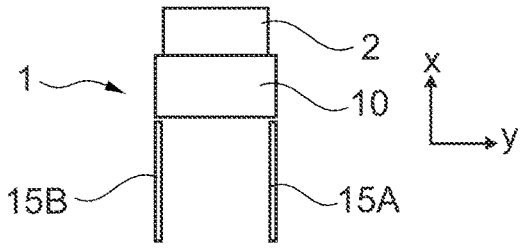
Figure 2C:
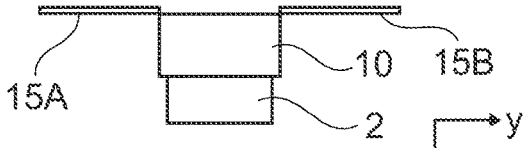
Figure 2D:
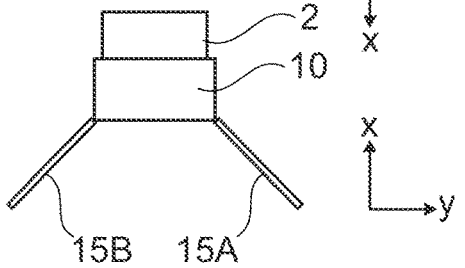

In FIG. 2A, the configuration having the smallest space requirement is shown, which corresponds to the schematic view of FIGS. 1A and 1B. The top view of FIG. 2B here corresponds to the schematic illustration of FIG. 1C. FIGS. 2C and 2D illustrate further exemplary construction variants which demonstrate the variety of possible uses. In FIG. 2B, as in FIG. 1C, the inner module 2 is arranged with its end face on one end face of the outer module 10 and the two hinged wall elements 15A, 15B are folded out by 90°. The hinged wall elements 15A, 15B are arranged here and in the other examples on the end face of the outer element 10, on which the inner element 2 is not arranged. In FIG. 2C, the hinged wall elements are unfolded by 180°, in FIG. 2D by 135°. The hinged wall elements 15A, 15B can be locked in the position shown in each case.

In FIGS. 3A to 3D, exemplary usage variants are shown schematically in a top view.

Figure 3A:
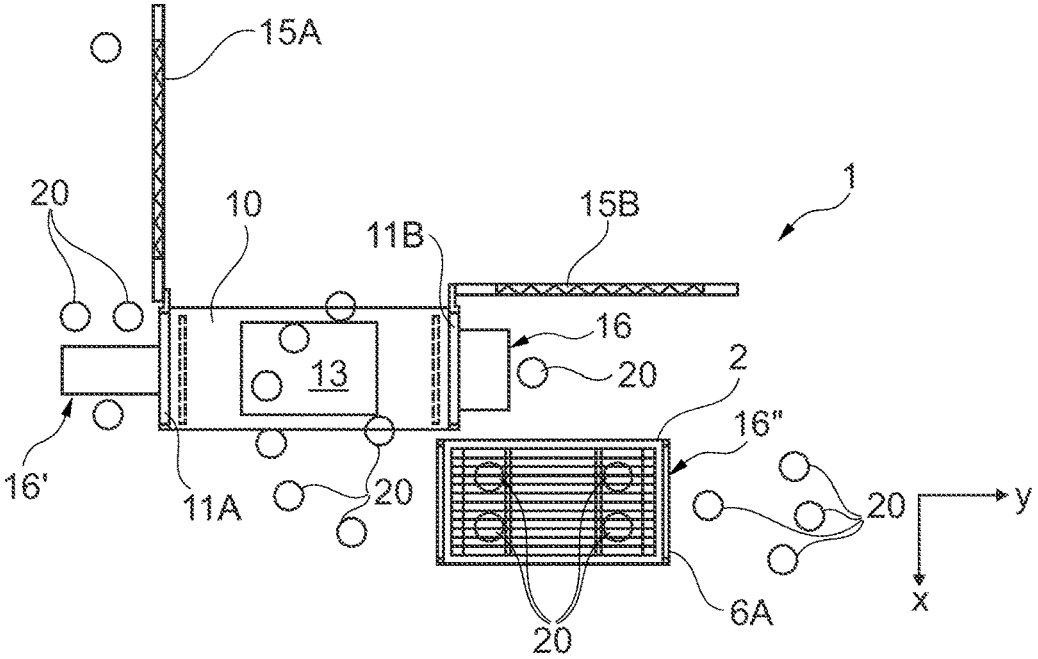

In FIG. 3A, the outer element 10 is thus equipped with respective productive devices 16, 16' on both side walls 11A, 11B. The productive device 16 can be, for example, the workstation, also shown in FIG. 1C, at which a single person 20 works. The further productive device 16' can be, for example, a folding table productive device at which a plurality of people 20 discuss something or simply only drink coffee together. A presentation is currently carried out in the inner space 13 of the outer element 10, while in the inner space 9 of the inner element 2, four people 20 are in turn having a discussion. Furthermore, an outer side of a side wall 6A, which is also provided with a productive device 16" such as a whiteboard productive device, is used by further people 20 for a small brainstorming session. The two hinged wall elements 15, 15A are locked in the present case at different angles, namely once at 90° and once at 180°. The interaction with drawn, acoustically damping curtains on the end face of the inner element 2 facing the productive device 16 and the hinged wall element 15B opened by 180° results in a relatively quiet work niche on the productive device 16 in the present configuration.

Figure 3B:
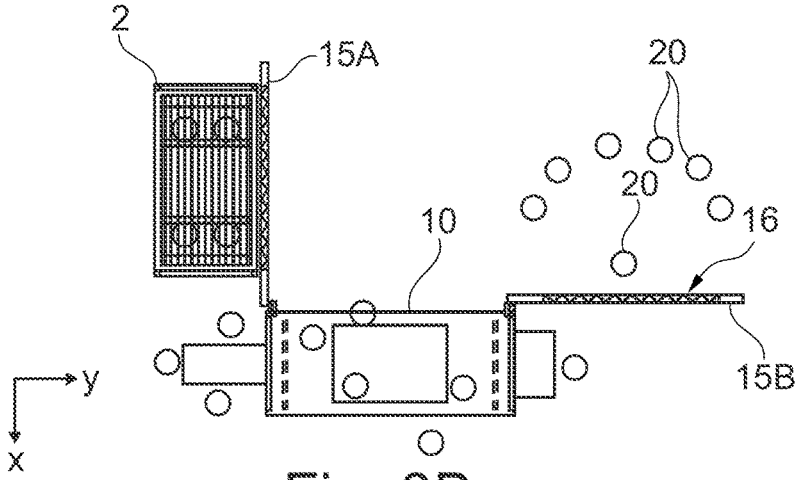

A variation of the usage variant of FIG. 3A is shown in FIG. 3B, in which the inner element 2 is arranged with its end face on the hinged wall element 15A opened by 90° with unchanged outer element 10 and unchanged hinged wall elements 15A, 15B. This results in a quiet consultation niche in the inner space 9 of the inner element 2. At the same time, in the example shown, an inside of the hinged wall element 15B is used for a presentation, for example, with a whiteboard productive device 16, which is suspended on the inner side of the hinged wall element 15B.

Figure 3C:
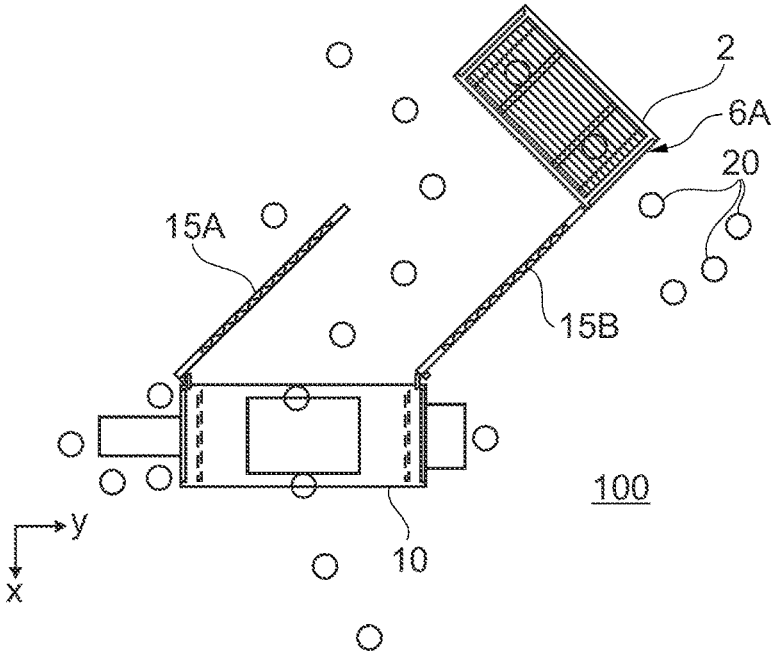

In FIG. 3C, a further usage variant is shown in which one hinged wall element 15A is opened by 45°, and the other hinged wall element 15B by 135°. The inner element 2 is arranged with its end face at right angles to the hinged wall element 15B at the end of the hinged wall element 15B folded by 135°. In this way, a region is separated from the work environment 100, which due to the fact that the outer element 10 can be walked through, for example, can be used for access control as part of a hygiene concept. At the same time, people 20 carry out further productive work here on an outer side 6A of the inner element 2.

Figure 3D:
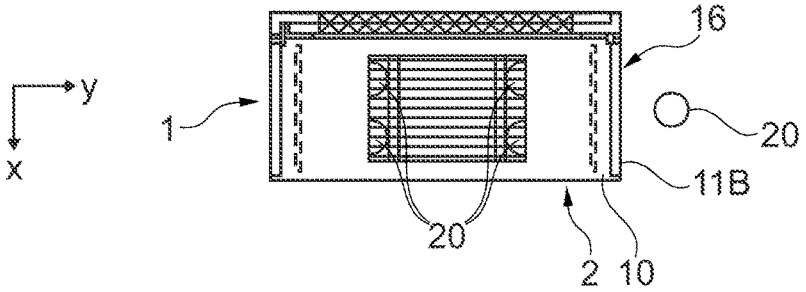

FIG. 3D shows the usage variant again as it corresponds to FIG. 2A or 1A and 1B, namely the work and recreation space module 1 in the configuration having the smallest possible space requirement. It can still be used in qualitatively different ways, in the present case by people 20 in the inner space 9 of the inner element 2, and at the same time by a person 20 who uses a productive device 26 on an outer side 11 of a side wall 11B of the outer element 10.

What is claimed is:

1. A work and recreation space module for a work environment, the work and recreation space module comprising:

an inner element, which has at least one seat for a user, wherein the inner element has a rolling device for rolling the inner element into different positions in the work environment;

an outer element which has two side walls and a roof connecting the two side walls, wherein the inner element is able to be received in an inner space of the outer element, wherein the inner space of the outer element is delimited by the two side walls and the roof of the outer element; and a mechanical coupling device with which the inner element and the outer element can be coupled to one another and decoupled from each other by pushing into, and pulling out, respectively, by hand, so that the outer element can also be rolled by the rolling device of the inner element into different positions in the work environment when coupled to the inner element;

wherein the mechanical coupling device comprises a nose in one element selected from the group consisting of the inner element and the outer element, and a recess in one other element selected from the group consisting of the inner element and the outer element, wherein the nose, when raised, engages in the recess of the other element, and prevents the outer element from slipping relative to the inner element.

2. The work and recreation space module according to claim 1, wherein the inner element has two side walls and a roof connecting the two side walls and a bottom connecting the two side walls, wherein the two side walls and the bottom delimit an inner space of the inner element and, when the inner element is coupled to the outer element by means of the mechanical coupling device, the two side walls of the inner element run along the two side walls of the outer element.

3. The work and recreation space module according to claim 2, wherein the inner element is coupled to the outer element by the mechanical coupling device, and the roof of the inner element runs along the roof of the outer element.

4. The work and recreation space module according to claim 2, wherein the inner space of the inner element is open to an environment of the inner element on at least one of two end faces of the inner element that run transversely to the two side walls and roof of the inner element.

5. The work and recreation space module according to claim 2, wherein a privacy and/or sound protection device is arranged on one or both of the two side walls of the inner element and/or the roof of the inner element for the optical and/or acoustic separation of the inner space of the inner element from an environment of the inner element.

6. The work and recreation space module according to claim 1, wherein at least one respective inner side and/or outer side of the two side walls of the outer element and/or at least one respective outer side of the two side walls of the inner element can be provided or are provided with one or more productive devices.

7. The work and recreation space module according to claim 1, wherein a hinged wall element is arranged on at least one of the two side walls of the outer element at one of two end faces of the outer element running transversely to the two side walls and the roof of the outer element, wherein the hinged wall element is arranged to be pivotable about a vertical axis of the outer element running parallel to the two side walls.

8. The work and recreation space module according to claim 7, wherein the hinged wall element is also arranged to be lockable at different pivoting angles.

9. The work and recreation space module according to claim 7, wherein the dimensions of the hinged wall element are adapted to the size of the one of two end faces of the outer element so that the inner region of the outer element can be delimited from an environment of the outer element on the end face by the hinged wall element.

10. The work and recreation space module according to claim 1, wherein the inner element and the outer element have an electrical coupling device, via which, at least when the inner element is coupled to the outer element by means of the mechanical coupling device, the inner element and the outer element are electrically coupled or can be electrically coupled to one another.

11. The work and recreation space module according to claim 7, wherein at least one of the inner element, the outer element, and the hinged wall element has a current draw point and/or a lighting device.

12. The work and recreation space module according to claim 11, wherein the inner element and/or the outer element contains a storage for electrical energy.

* * * * *